US008901059B2

(12) United States Patent
Evers et al.

(10) Patent No.: US 8,901,059 B2
(45) Date of Patent: Dec. 2, 2014

(54) LIQUID HAND DISHWASHING DETERGENT COMPOSITION

(75) Inventors: Marc Francois Theophile Evers, Strombeek-Bever (BE); Tania Patricia Maddox, Overijse (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/819,253

(22) Filed: Jun. 21, 2010

(65) Prior Publication Data

US 2010/0323942 A1 Dec. 23, 2010

(30) Foreign Application Priority Data

Jun. 19, 2009 (EP) ..... 09163238

(51) Int. Cl.

| | |
|---|---|
| ***C11D 1/02*** | (2006.01) |
| ***C11D 1/72*** | (2006.01) |
| ***C11D 1/75*** | (2006.01) |
| ***C11D 1/83*** | (2006.01) |
| ***C11D 3/33*** | (2006.01) |
| ***C11D 3/36*** | (2006.01) |
| ***C11D 1/94*** | (2006.01) |

(52) U.S. Cl.

CPC .. *C11D 3/33* (2013.01); *C11D 1/83* (2013.01); *C11D 3/364* (2013.01); *C11D 1/94* (2013.01)

USPC ..... 510/237; 510/421; 510/422; 510/423; 510/426; 510/427; 510/433; 510/477; 510/488; 510/503; 510/505

(58) Field of Classification Search

USPC ..... 510/235, 237, 421, 422, 423, 426, 427, 510/433, 477, 488, 503, 505; 134/25.2

See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Kenkichi et al. | |
| 3,372,188 | A | 3/1968 | Alston et al. | |
| 3,812,044 | A | 5/1974 | Connor et al. | |
| 3,915,903 | A | 10/1975 | Wise | |
| 4,608,197 | A | 8/1986 | Kesling, Jr. et al. | |
| 4,663,071 | A | 5/1987 | Bush et al. | |
| 4,704,233 | A | 11/1987 | Hartman et al. | |
| 5,783,539 | A * | 7/1998 | Angevaare et al. | 510/223 |
| 5,798,505 | A | 8/1998 | Lee | |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,172,021 | B1 | 1/2001 | Ofosu-Asante et al. | |
| 6,281,181 | B1 | 8/2001 | Vinson et al. | |
| 6,426,229 | B1 | 7/2002 | Yamamoto et al. | |
| 6,455,482 | B1 | 9/2002 | D Ambrogio et al. | |
| 6,472,363 | B1 | 10/2002 | Arvanitidou et al. | |
| 6,821,939 | B1 | 11/2004 | Szewczyk et al. | |
| 2003/0064900 | A1 | 4/2003 | Borgonjon et al. | |
| 2003/0100464 | A1 * | 5/2003 | Kott et al. | 510/357 |
| 2003/0148906 | A1 | 8/2003 | Alam et al. | |
| 2004/0005991 | A1 | 1/2004 | Boucher et al. | |
| 2004/0072717 | A1 * | 4/2004 | Cordellina et al. | 510/481 |
| 2006/0019851 | A1 | 1/2006 | Hecht et al. | |
| 2006/0105931 | A1 * | 5/2006 | Shi et al. | 510/235 |
| 2008/0261851 | A1 | 10/2008 | Barthel et al. | |
| 2009/0082242 | A1 * | 3/2009 | Brooker et al. | 510/220 |
| 2010/0323943 | A1 | 12/2010 | Evers et al. | |

FOREIGN PATENT DOCUMENTS

| | | | |
|---|---|---|---|
| DE | 735096 | | 12/1991 |
| EP | 0 686 693 | A2 | 12/1995 |
| EP | 0 709 451 | A1 | 5/1996 |
| EP | 0 859 044 | | 8/1998 |
| JP | A-H09-221697 | | 8/1997 |
| JP | A-H10-226800 | | 8/1998 |
| JP | A-2002-535439 | | 10/2002 |
| JP | A-2002-535443 | | 10/2002 |
| JP | A-2006-182905 | | 7/2006 |
| JP | A-2006-193732 | | 7/2006 |
| JP | A-2007-016131 | | 1/2007 |
| JP | A-2007-016132 | | 1/2007 |
| JP | A-2007-023210 | | 2/2007 |
| JP | A-2007-177128 | | 7/2007 |
| JP | A-2008-156589 | | 7/2008 |
| JP | A-2008-156590 | | 7/2008 |
| WO | WO 92/08777 | | 5/1992 |
| WO | WO 97/38956 | A1 | 10/1997 |
| WO | WO 99/05082 | | 2/1999 |
| WO | WO 99/05084 | | 2/1999 |
| WO | WO 99/05241 | | 2/1999 |
| WO | WO 99/05242 | | 2/1999 |
| WO | WO 99/05243 | | 2/1999 |
| WO | WO 99/05244 | | 2/1999 |
| WO | WO 99/07656 | | 2/1999 |
| WO | WO 99/19439 | A1 | 4/1999 |
| WO | WO 00/23548 | | 4/2000 |
| WO | WO 00/23549 | | 4/2000 |
| WO | WO 00/71667 | | 11/2000 |
| WO | WO 2006/014740 | | 2/2006 |
| WO | WO 2007/135645 | | 11/2007 |
| WO | WO 2007/138053 | | 12/2007 |

OTHER PUBLICATIONS

International Search Report, PCT/US 2010/038598, dated Jun. 15, 2010.

International Search Report, PCT/US 2010/038566, dated Jun. 15, 2010.

* cited by examiner

*Primary Examiner* — Gregory R DelCotto

(74) *Attorney, Agent, or Firm* — Amy I Ahn-Roll; Steven Miller

(57) ABSTRACT

A hand dishwashing detergent composition comprising a chelant and branched surfactants to provide superior grease cleaning and shine.

3 Claims, No Drawings

LIQUID HAND DISHWASHING DETERGENT COMPOSITION

FIELD OF INVENTION

The present invention relates to a liquid hand dishwashing composition, and to a method of cleaning dishware with such detergent composition, comprising a chelant and surfactant with an average branching of at least 10%, to provide superior cleaning and shine.

BACKGROUND OF THE INVENTION

Optimization of grease cleaning is an ongoing task in the field of hand dishwashing. Consumers utilizing liquid detergent as a light-duty liquid dishwashing detergent composition tend to wash greasy, difficult to clean items at the end of their washing experience, after easier to clean items such as glasses and flatware are cleaned. Light-duty liquid dishwashing detergent compositions require a high suds profile while providing grease cleaning.

Minimum surfactant is needed to ensure grease cleaning and sudsing under neat and diluted usage. However, surfactant can leave visible films and cause streaks and spots on the rinsed dishware surfaces. Shine is however also a critical benefit for the consumers. It has been surprisingly found that superior shine is provided with a combination of a chelant with a surfactant system designed such as the average alkyl chain branching of the total surfactant system is at least 10%.

The object of the present invention is to provide hand dishwashing compositions which provide superior cleaning and shine.

SUMMARY OF THE INVENTION

The present application relates to a liquid hand dishwashing detergent composition comprising:

(a) from 0.1% to 20% by weight of the total composition of a chelant, (b) from 5% to 80% by weight of the total composition of a surfactant selected from the group consisting of anionic, nonionic, cationic, amphoteric, zwitterionic, semi-polar nonionic surfactants and mixtures thereof; wherein the average alkyl chain branching of the surfactants is at least 10% by weight of the total surfactants.

The present invention further relates to a method of cleaning dishware with such liquid detergent composition.

DETAILED DESCRIPTION OF THE INVENTION

The liquid hand dishwashing detergent composition and the method of cleaning dishware of the present invention surprisingly provides excellent grease cleaning combined with superior shine.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "suds profile" means the amount of sudsing (high or low) and the persistence of sudsing (sustained sudsing) throughout the washing process resulting from the use of the liquid detergent composition of the present composition. As used herein "high sudsing" refers to liquid hand dishwashing detergent compositions which are both high sudsing (i.e. a level of sudsing considered acceptable to the consumer) and have sustained sudsing (i.e. a high level of sudsing maintained throughout the dishwashing operation).

This is particularly important with respect to liquid dishwashing detergent compositions as the consumer uses high sudsing as an indicator of the performance of the detergent composition. Moreover, the consumer of a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "liquid hand dishwashing detergent composition" refers to those compositions that are employed in manual (i.e. hand) dishwashing. Such compositions are generally high sudsing or foaming in nature.

As used herein "cleaning" means applying to a surface for the purpose of cleaning, and/or disinfecting.

The Liquid Composition

The liquid detergent compositions herein generally contain from 30% to 95%, preferably 40% to 80%, more preferably 50% to 75% of an aqueous liquid carrier, preferably water, in which the other essential and optional compositions components are dissolved, dispersed or suspended.

The compositions of the present invention provide superior cleaning and superior shine. Efficient cleaning actives such as anionic surfactant systems based on alkylsulphates and alkylbenzene sulphonates result in crystalline deposition on surfaces that make their appearance dull and/or leave films, streaks and spots. This because the cleaning actives form insoluble salts with the Ca/Mg ions in the water. It has been found that chelants with crystal growth inhibiting properties will prevent the formation of crystals, especially in soiled conditions and therefore will provide shine on washed dish items. Surprisingly, it has been further found that the combination of chelants and a surfactant system characterized by an average alkyl chain branching of at least 10% of the total surfactant system provides superior shine. Without wishing to be bound by theory, it is believed that a combination of chelants with branched surfactants ensures superior film clarification by disrupting and preventing the formation of the crystalline film formed by salts formed and improves further the wetting on surface. Net, the combination of the chelant and a branched surfactant system will prevent efficiently the formation of crystalline films of the dish surface and will provide improved wetting and thereby providing superior shine.

The Chelant

The composition of the present invention comprises a chelant at a level of from 0.1% to 20%, preferably from 0.2% to 5%, more preferably from 0.2% to 3% by weight of total composition.

As commonly understood in the detergent field, chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinsed away and do not form a deposit.

Suitable chelating agents can be selected from the group consisting of amino carboxylates, amino phosphonates, polufunctionally-substituted aromatic chelating agents and mixtures thereof.

Preferred chelants for use herein are the amino acids based chelants and preferably glutamic-N,N-diacetic acid and derivatives and/or Phosphonate based chelants and preferably Diethylenetriamine penta methylphosphonic acid.

Amino carboxylates include ethylenediaminetetra-acetates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), □-alanine-N,N-diacetic acid (□-ALDA), serine-N, N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N, N-diacetic acid (TUDA) and sulfomethyl-N,N-diacetic acid (SMDA) and alkali metal salts or ammonium salts thereof. Also suitable is ethylenediamine disuccinate ("EDDS"), especially the [S, S] isomer as described in U.S. Pat. No. 4,704,233. Furthermore, Hydroxyethyleneiminodiacetic acid, Hydroxyiminodisuccinic acid, Hydroxyethylene diaminetriacetic acid are also suitable.

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis (methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants for use herein include citric acid, lactic acid, acetic acid, succinic acid, formic acid; all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Preferred Surfactant System

The composition of the present invention will comprise a surfactant selected from anionic, nonionic, cationic, amphoteric, zwitterionic, semi-polar nonionic surfactants, and mixtures thereof. The surfactants of the composition will have an average branching of the alkyl chain(s) of more than 10%, preferably more than 20%, more preferably more than 30% and even more preferably more than 40% by weight of the total surfactants.

The surfactants of the present invention will generally be comprised at a level of 5% to 80%, preferably 10% to 60%, more preferably 12% to 45% by weight of the total composition.

In a preferred embodiment, the composition of the present invention will further comprise a nonionic surfactant and more preferably at a weight ratio of total surfactant to nonionic surfactant of 2 to 10, preferably of 2 to 7.5, more preferably of 2 to 6.

The surfactants described below can be used in their linear and/or branched version.

Nonionic Surfactants

Preferred for use in the present invention are nonionic surfactants. Indeed, it has been found that the addition of nonionic surfactants and preferably of branched nonionic surfactants, will prevent efficiently the formation of crystalline films of the dish surface and will provide improved wetting and thereby providing superior shine.

Nonionic surfactant is comprised in a typical amount of from 2% to 40%, preferably 3% to 30% by weight of the liquid detergent composition and preferably from 3 to 20% by weight of the total composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 8 to 18 carbon atoms, preferably from 9 to 15 carbon atoms with from 2 to 18 moles, preferably 2 to 15, more preferably 5-12 of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkyl glycerol ethers and sorbitan esters.

Also suitable are fatty acid amide surfactants having the formula (IV):

$$R^6\overset{\overset{\displaystyle O}{\|}}{C}N(R^7)_2 \qquad \text{(IV)}$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and $—(C_2H_4O)_xH$ where x of formula (IV) varies from 1 to 3. Preferred amides are $C_8$-$C_{20}$ ammonia amides, monoethanolamides, diethanolamides, and isopropanolamides.

Preferred nonionic surfactants for use in the present invention are the condensation products of aliphatic alcohols with ethylene oxide, such as the mixture of nonyl (C9), decyl (C10) undecyl (C11) alcohol modified with on average 5 ethylene oxide (EO) units such as the commercially available Neodol 91-5 or the Neodol 91-8 that is modified with on average 8 EO units. Also suitable are the longer alkyl chains ethoxylated nonionics such as C12, C13 modified with 5 EO (Neodol 23-5). Neodol is a Shell tradename. Also suitable is the C12, C14 alkyl chain with 7 EO, commercially available under the trade name Novel 1412-7 (Sasol) or the Lutensol A 7 N (BASF)

Preferred branched nonionic are the Guerbet C10 alcohol ethoxylates with 5 EO such as Ethylan 1005, Lutensol XP 50 and the Guerbet C10 alcohol alkoxylated nonionics (modified with EO and PO=propyleneoxyde) such as the commercially available Lutensol XL series (X150, XL70, . . . ). Other branching also include oxo branched nonionic surfactants such as the Lutensol ON 50 (5 EO) and Lutensol ON70 (7 EO). Other suitable branched nonionics are the ones derived from the isotridecyl alcohol and modified with ethyleneoxyde such as the Lutensol TO7 (7EO) from BASF and the Marlipal O 13/70 (7EO) from Sasol. Also suitable are the ethoxylated fatty alcohols originating from the Fisher & Troshp reaction comprising up to 50% branching (40% methyl (mono or bi) 10% cyclohexyl) such as those produced from the Safol™ alcohols from Sasol; ethoxylated fatty alcohols originating from the oxo reaction wherein at least 50 weight % of the alcohol is C2 isomer (methyl to pentyl) such as those produced from the Isalchem™ alcohols or Lial™ alcohols from Sasol; the ethoxylated fatty alcohols originating from the modified oxo reaction wherein at least 15 weight % of the alcohol is C2 isomer (methyl to pentyl) such as those produced from the Neodol™ alcohols from Shell.

Amphoteric/Zwitterionic Surfactants

The amphoteric and zwitterionic surfactant can be comprised at a level of from 0.01% to 20%, preferably from 0.2% to 15%, more preferably 0.5% to 10% by weight of the liquid detergent composition. The compositions of the present invention will preferably further comprise an amine oxide and/or a betaine.

Most preferred amine oxides are coco dimethyl amine oxide or coco amido propyl dimethyl amine oxide. Amine oxide may have a linear or mid-branched alkyl moiety. Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3)→O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides.

As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \qquad \text{(I)}$$

wherein $R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \qquad \text{(Ia)}$$

$$R^1—CO—NH(CH_2)_3—N^+(CH_3)_2—CH_2COO^- \qquad \text{(Ib)}$$

$$R^1—N^+(CH_3)_2—CH_2CH(OH)CH_2SO_3— \qquad \text{(Ic)}$$

$$R^1—CO—NH—(CH_2)_3—N^+(CH_3)_2—CH_2CH(OH)CH_2SO_3— \qquad \text{(Id)}$$

in which $R^1$1 as the same meaning as in formula I. Particularly preferred betaines are the Carbobetaine [wherein $Y^- = COO^-$], in particular the Carbobetaine of the formula (Ia) and (Ib), more preferred are the Alkylamidobetaine of the formula (Ib).]

Examples of suitable betaines and sulfobetaine are the following [designated in accordance with INC]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines. Preferred betaine is for example Cocam idopropyl betaines (Cocoamidopropylbetain).

Anionic Surfactant

Suitable anionic surfactants to be used in the compositions and methods of the present invention are sulfates, sulfosuccinates, sulfoacetates, and/or sulfonates; preferably alkyl sulfate and/or alkyl ethoxy sulfates; more preferably a combination of alkyl sulfates and/or alkyl ethoxy sulfates with a combined ethoxylation degree less than 5, preferably less than 3, more preferably less than 2.

Sulphate or sulphonate surfactant is typically present at a level of at least 5%, preferably from 5% to 40% and more preferably from 15% to 30% and even more preferably at 15% to 25% by weight of the liquid detergent composition.

Suitable sulphate or sulphonate surfactants for use in the compositions herein include water-soluble salts or acids of $C_{10}$-$C_{14}$ alkyl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises $C_{1-4}$ alkyl branching units. The average percentage branching of the sulphate or sulphonate surfactant is preferably greater than 30%, more preferably from 35% to 80% and most preferably from 40% to 60% of the total hydrocarbyl chains.

The sulphate or sulphonate surfactants may be selected from $C_{11}$-$C_{18}$ alkyl benzene sulphonates (LAS), $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. Nos. 6,020,303 and 6,060,443; mid-chain branched alkyl alkoxy sulphates as discussed in U.S. Pat. Nos. 6,008,181 and 6,020,303; modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS).

The paraffin sulphonates may be monosulphonates or disulphonates and usually are mixtures thereof, obtained by sulphonating paraffins of 10 to 20 carbon atoms. Preferred sulphonates are those of C12-18 carbon atoms chains and more preferably they are C14-17 chains. Paraffin sulphonates that have the sulphonate group(s) distributed along the paraffin chain are described in U.S. Pat. Nos. 2,503,280; 2,507,088; 3,260,744; 3,372,188 and in DE 735 096.

Also suitable are the alkyl glyceryl sulphonate surfactants and/or alkyl glyceryl sulphate surfactants described in the Procter & Gamble patent application WO06/014740: A mixture of oligomeric alkyl glyceryl sulfonate and/or sulfate surfactant selected from dimers, trimers, tetramers, pentamers, hexamers, heptamers, and mixtures thereof; wherein the weight percentage of monomers is from 0 wt % to 60 wt % by weight of the alkyl glyceryl sulfonate and/or sulfate surfactant mixture.

Other suitable anionic surfactants are alkyl, preferably dialkyl sulfosuccinates and/or sulfoacetate. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moiety.es). Preferably, the alkyl moiety is symmetrical.

Most common branched anionic alkyl ether sulphates are obtained via sulfation of a mixture of the branched alcohols and the branched alcohol ethoxylates. Also suitable are the sulfated fatty alcohols originating from the Fisher & Troshp reaction comprising up to 50% branching (40% methyl (mono or bi) 10% cyclohexyl) such as those produced from the Safol™ alcohols from Sasol; sulfated fatty alcohols originating from the oxo reaction wherein at least 50 weight % of the alcohol is C2 isomer (methyl to pentyl) such as those produced from the Isalchem™ alcohols or Lial™ alcohols from Sasol; the sulfated fatty alcohols originating from the modified oxo reaction wherein at least 15 weight % of the alcohol is C2 isomer (methyl to pentyl) such as those produced from the Neodol™ alcohols from Shell.

Cationic Surfactants

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

(V)

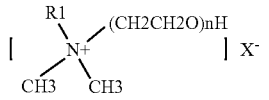

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

Cleaning Polymer

The composition used in the method of the present invention can further comprise one or more alkoxylated polyethyleneimine polymer. The composition may comprise from 0.01 wt % to 10 wt %, preferably from 0.01 wt % to 2 wt %, more preferably from 0.1 wt % to 1.5 wt %, even more preferable from 0.2% to 1.5% by weight of the composition of an alkoxylated polyethyleneimine polymer as described on page 2, line 33 to page 5, line 5 and exemplified in examples 1 to 4 at pages 5 to 7 of WO2007/135645 published by The Procter & Gamble Company.

The alkoxylated polyethyleneimine polymer of the present composition has a polyethyleneimine backbone having from 400 to 10000 weight average molecular weight, preferably from 400 to 7000 weight average molecular weight, alternatively from 3000 to 7000 weight average molecular weight.

These polyamines can be prepared for example, by polymerizing ethyleneimine in presence of a catalyst such as carbon dioxide, sodium bisulfite, sulfuric acid, hydrogen peroxide, hydrochloric acid, acetic acid, and the like.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000 described in BASF patent application WO2007/138053 on pages 2 line 14 to page 10, line 34 and exemplified on pages 15-18.

Salts and Solvents

Salts and solvents are generally used to ensure preferred product quality for dissolution, thickness and aesthetics and to ensure better processing. When salts are included, the ions can be selected from magnesium, sodium, potassium, calcium, and/or magnesium and preferably from sodium and magnesium, and are added as a hydroxide, chloride, acetate, sulphate, formate, oxide or nitrate salt to the compositions of the present invention. Salts are generally present at an active level of from 0.01% to 5%, preferably from 0.015% to 3%, more preferably from 0.025% to 2.0%, by weight of the liquid detergent composition. However, for the compositions of the present invention, additional magnesium ions should be avoided.

Suitable solvents include $C_1$-$C_5$ alcohols are according to the formula R—OH wherein R is a linear saturated alkyl group of from 1 to 5 carbon atoms, preferably from 2 to 4. Suitable alcohols are ethanol, propanol, isopropanol or mixtures thereof. Other suitable alcohols are alkoxylated C1-8 alcohols according to the formula R (A0n-oh wherein R is a linear alkyl group of from 1 to 8 carbon atoms, preferably from 3 to 6, wherein A is an alkoxy group preferably propoxy and/or ethoxy and n is an integer of from 1 to 5, preferably from 1 to 2. Suitable alcohols are buthoxy propoxy propanol (n-BPP), buthoxy Propanol (n-BP) buthoxyethanol or mixtures thereof. Suitable alkoxylated aromatic alcohols to be used herein are according to the formula R (B)n-OH whereinm R is an alkyl substituted or non alkyl substituted aryl group of from 1 to 20 carbon atoms, preferably from 2 to 15 and more preferably from 2 to 10, wherein B is an alkoxy group preferably buthoxy, propoxy and/or ethoxy and n is an integer from of from 1 to 5, preferably from 1 to 2. Suitable alkoxylated aromatic alcohols are benzoyethanol and or benzoypropanol. A suitable aromatic alcohol to be use dherein is benzyl alcohol. Other suitable solvenst include butyl diglycolether, benzylalcohol, propoxyporpoxypropanol (EP 0 859 044) ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from 0.01% to 20%, preferably from 0.5% to 20%, more preferably from 1% to 10% by weight of the liquid detergent composition of a solvent. These solvents may be used in conjunction with an aqueous liquid carrier, such as water, or they may be used without any aqueous liquid carrier being present.

Hydrotrope

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903. The liquid detergent compositions of the present invention typically comprise from 0% to 15% by weight of the liquid detergent composition of a hydrotropic, or mixtures thereof, preferably from 1% to 10%, most preferably from 3% to 6% by weight.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino)alkyl esters and (N,N-dialkylamino)alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate esters, namely the acrylate ester represented by the formula (VII):

(VII)

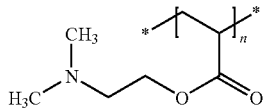

Other preferred suds boosting polymers are copolymers of hydroxypropylacrylate/dimethyl aminoethylmethacrylate (copolymer of HPA/DMAM), represented by the formulae VIII and IX (VIII)

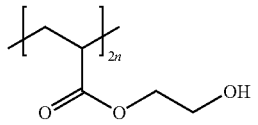

(IX)

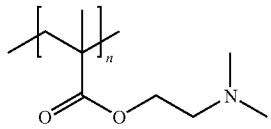

When present in the compositions, the polymeric suds booster/stabilizer may be present in the composition from 0.01% to 15%, preferably from 0.05% to 10%, more preferably from 0.1% to 5%, by weight of the liquid detergent composition.

Another preferred class of polymeric suds booster polymers are hydrophobically modified cellulosic polymers having a number average molecular weight (Mw) below 45,000; preferably between 10,000 and 40,000; more preferably between 13,000 and 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

Diamines

Another optional ingredient of the compositions according to the present invention is a diamine. Since the habits and practices of the users of liquid detergent compositions show considerable variation, the composition will preferably contain 0% to 15%, preferably 0.1% to 15%, preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines. pKa is used herein in the same manner as is commonly known to people skilled in the art of chemistry: in an all-aqueous solution at 25° C. and for an ionic strength between 0.1 to 0.5 M. Values referenced herein can be obtained from literature, such as from "Critical Stability Constants: Volume 2, Amines" by Smith and Martel, Plenum Press, NY and London, 1975.

Carboxylic Acid

The liquid detergent compositions according to the present invention may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishware.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof, citric acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5%.

Other Optional Components:

The liquid detergent compositions herein can further comprise a number of other optional ingredients suitable for use in liquid detergent compositions such as perfume, dyes, pearlescent agents, opacifiers, enzymes preferably a protease, thickening agents, preservatives, disinfecting agents and pH buffering means so that the liquid detergent compositions herein generally have a pH of from 3 to 14, preferably 6 to 13, most preferably 8 to 11. The pH of the composition can be adjusted using pH modifying ingredients known in the art.

A further discussion of acceptable optional ingredients suitable for use in light-duty liquid detergent composition may be found in U.S. Pat. No. 5,798,505.

Viscosity

The compositions of the present invention preferably have viscosity from 50 to 2000 centipoises (50-2000 mPa*s), more preferably from 100 to 1500 centipoises (100-1500 mPa*s), and most preferably from 500 to 1300 centipoises (500-1300 mPa*s) at $20^{s-1}$ and 20° C. Viscosity can be determined by conventional methods. Viscosity according to the present invention is measured using an AR 550 rheometer from TA instruments using a plate steel spindle at 40 mm diameter and a gap size of 500 μm. The high shear viscosity at $20^{s-1}$ and low shear viscosity at $0.05^{s-1}$ can be obtained from a logarithmic shear rate sweep from $0.1^{s-1}$ to $25^{s-1}$ in 3 minutes time at 20° C. The preferred rheology described therein may be achieved using internal existing structuring with detergent ingredients or by employing an external rheology modifier. Hence, in a preferred embodiment of the present invention, the composition comprises further a rheology modifier.

The Process of Cleaning/Treating a Dishware

The method of dishwashing of the present invention comprises cleaning a dishware with a liquid hand dishwashing composition comprising a protease and a pearlescent agent. Said dishwashing operation comprises the steps of applying said composition onto said dishware, typically in diluted or neat form and rinsing said composition from said surface, or leaving said composition to dry on said surface without rinsing said surface. Instead of leaving said composition to dry on said surface on the air, it can also be hand-dried using a kitchen towel. During the dishwashing operation, particularly during the application of said liquid composition to the dishware and/or rinsing away of said liquid composition from the dishware, the hands and skin of the user may be exposed to the liquid composition in diluted or neat form.

By "in its neat form", it is meant herein that said liquid composition is applied directly onto the surface to be treated without undergoing any dilution by the user (immediately) prior to the application. This direct application of that said liquid composition onto the surface to be treated can be achieved through direct squeezing of that said liquid composition out of the hand dishwashing liquid bottle onto the surface to be cleaned, or through squeezing that said liquid composition out of the hand dishwashing liquid bottle on a pre-wetted or non pre-wetted cleaning article, such as without intending to be limiting a sponge, a cloth or a brush, prior to cleaning the targeted surface with said cleaning article. By "diluted form", it is meant herein that said liquid composition is diluted by the user with an appropriate solvent, typically with water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually 0.1 to 20 liters.

In one embodiment of the present invention, the composition herein can be applied in its diluted form. Soiled dishes are contacted with an effective amount, typically from 0.5 ml to 20 ml (per 25 dishes being treated), preferably from 3 ml to 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Typical light-duty detergent compositions are described in the examples section.

Generally, from 0.01 ml to 150 ml, preferably from 3 ml to 40 ml, even more preferably from 3 ml to 10 ml of a liquid detergent composition of the invention is combined with from 2000 ml to 20000 ml, more typically from 5000 ml to 15000 ml of water in a sink having a volumetric capacity in the range of from 1000 ml to 20000 ml, more typically from 5000 ml to 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from 1 to 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of a concentrated pre-mix of diluted liquid dishwashing detergent, for a period of time typically ranging from 1 to 5 seconds. The absorbing device, and consequently the diluted liquid dishwashing composition, is then contacted individually to the surface of each of the soiled dishes to remove said soiling. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing. Typically, said concentrated pre-mix of diluted liquid dishwashing detergent is formed by combining 1 ml to 200 ml of neat dishwashing detergent with 50 ml to 1500 ml of water, more typically from 200 ml to 1000 ml of water.

Packaging

The liquid detergent compositions of the present invention may be packages in any suitable packaging for delivering the liquid detergent composition for use. Preferably the package is a clear package made of glass or plastic.

EXAMPLES

| | Ex. 1 | Ex. 2 | Ex. 3 | Ex. 4 | Ex. 5 | Ex. 6 | Ex. 7 |
|---|---|---|---|---|---|---|---|
| Alkyl Ethoxy Sulfate AExS* | 22.5 | 25.0 | 25.0 | 27.0 | 20.0 | 22.5 | 22.5 |
| w % linear in alkyl chain | 45 | 84 | 70 | 50 | 76 | 76 | 40 |
| w % branching in alkyl chain | 55 | 16 | 30 | 50 | 24 | 24 | 60 |
| Amine oxide | 8.0 | 6.0 | 7.0 | 5.0 | 5.0 | 8.0 | 7.0 |
| Nonionic | | | | | | | |
| C9-11 EO8 (15% branching) | 7.0 | — | — | 3.0 | 5.0 | — | 4.0 |
| Ethylan 1008 (100% branching) | — | — | 3.0 | — | — | 7.0 | — |
| Lutensol TO7 (100% branching) | — | 7.0 | — | — | 5.0 | — | 3.0 |
| GLDA[1] | 1.0 | — | — | — | 1.0 | 0.5 | 0.8 |
| DTPMP[2] | — | 1.0 | — | — | 0.5 | — | 0.4 |
| DTPA[3] | — | — | 1.0 | — | — | — | — |
| MGDA[4] | — | — | — | 1.0 | — | 0.5 | — |
| Sodium Citrate | — | — | 1.0 | — | 0.5 | 0.8 | — |
| Solvent: ethanol, isopropylalcohol, . . . | 2.5 | 7.0 | 4.0 | 3.0 | 2.0 | 3.0 | 2.5 |
| Polypropylene glycol MW2000 | 1.0 | 1.5 | 0.5 | 1.0 | — | 2.0 | 1.0 |
| Sodium Chloride | 0.5 | 0.8 | 1.0 | 1.0 | 0.5 | 0.5 | 0.5 |
| Average branching weight % in total surfactant mixture | 35.8 | 28.9 | 30.0 | 39.8 | 30.1 | 33 | 46.8 |
| Total Surfactant/Nonionic weight ratio | 5.3 | 5.4 | 11.6 | 11.7 | 3.5 | 5.4 | 5.2 |

-continued

| | Ex. 8 | Ex. 9 | Ex. 10 | Ex. 11 |
|---|---|---|---|---|
| Alkyl Ethoxy Sulfate AExS* | 13 | 16 | 17 | 15 |
| w % linear in alkyl chain | 70 | 60 | 84 | 45 |
| w % branching in alkyl chain | 30 | 40 | 16 | 55 |
| Amine oxide | 4.5 | 5.5 | 6.0 | 5.0 |
| Nonionic | | | | |
| C9-11 EO8 (15% branching) | — | 2.0 | — | 5 |
| Ethylan 1008 (100% branching) | — | 2.0 | — | — |
| Lutensol TO7 (100% branching) | 4 | — | 5 | — |
| GLDA[1] | 0.7 | 0.4 | 0.7 | 0.7 |
| DTPMP[2] | — | 0.3 | — | — |
| Sodium Citrate | — | — | 0.2 | — |
| Solvent: ethanol, isopropylalcohol, . . . | 2.0 | 2.0 | 2.0 | 1.0 |
| Polypropylene glycol MW 2000 | 0.5 | 0.3 | 0.5 | 0.4 |
| Salt: Sodium Chloride | 0.5 | 0.8 | 0.4 | 0.5 |
| Average branching weight % in total surfactant mixture | 17.3 | 14.9 | 12.4 | 36.0 |
| Total surfactant/Nonionic weight ratio | 5.4 | 6.4 | 5.6 | 5.0 |

| | Ex. 12 | Ex. 13 | Ex. 14 | Ex. 15 | Ex. 16 |
|---|---|---|---|---|---|
| Linear Alkylbenzene Sulfonate | 21.0 | 21.0 | 12.0 | 13.0 | — |
| Alkyl Ethoxy Sulfate AExS* | — | — | 14.0 | 5.0 | 17.0 |
| w % linear in alkyl chain | | | 76 | 84 | 60 |
| w % branching in alkyl chain | | | 24 | 16 | 40 |
| C12-14 alpha olefin sulfonate | — | — | — | — | 6.0 |
| Coco amido propyl Amine Oxide | — | — | — | 1.0 | 5.0 |
| alkylpolyglucoside | — | 2.0 | — | — | — |
| Nonionic | | | | | |
| C9-11 EO8 (15% branching) | — | — | 8.0 | — | 3.0 |
| Lutensol TO7 (100% branching) | 5.0 | 4.0 | — | 8.0 | — |
| GLDA[1] | 0.5 | — | — | — | — |
| DTPMP[2] | — | 0.8 | — | — | — |
| DTPA[3] | — | — | 0.5 | 0.8 | — |
| MGDA[4] | — | — | — | — | 1.0 |
| Average branching weight % in total surfactant mixture | 19.2 | 14.8 | 13.4 | 32.6 | 23.4 |
| Total surfactant/Nonionic weight ratio | 5.2 | 4.5 | 4.2 | 3.4 | 10.3 |

| | Ex. 17 | Ex. 18 | Ex. 19 | Ex. 20 | Ex. 21 |
|---|---|---|---|---|---|
| Alkyl Ethoxy Sulfate AExS* | 17.0 | 12.0 | 24.5 | 18.0 | 29.0 |
| w % linear in alkyl chain | 40 | 76 | 84 | 70 | 70 |
| w % branching in alkyl chain | 60 | 24 | 16 | 30 | 30 |
| C12-14 alpha olefin sulfonate | — | — | 1.0 | — | — |
| Paraffin Sulfonate (C15) | 9.0 | 1.0 | 1.0 | — | — |
| Coco amido propyl amine oxide | — | 6.0 | — | — | 1.0 |
| Coco amido propyl Betaine | — | — | — | 5.0 | — |
| Alkylpolyglucoside | — | 3.0 | — | — | — |
| Nonionic | | | | | |
| C9-11 EO8 (15% branching) | 8.0 | — | — | 3.0 | — |
| Lutensol TO7 (100% branching) | — | 2.0 | 2.5 | — | 4.0 |
| GLDA[1] | 0.5 | — | — | — | — |
| DTPMP[2] | — | 0.8 | — | — | — |
| DTPA[3] | — | — | 0.5 | 0.8 | — |
| MGDA[4] | — | — | — | — | 1.0 |
| Polypropylene glycol MW2000 | 1.0 | 1.0 | — | 0.5 | 0.5 |
| Average branching weight % in total surfactant mixture | 33.5 | 20.3 | 22.1 | 22.5 | 37.4 |
| Total surfactant/Nonionic weight ratio | 4.2 | 4.8 | 11.6 | 8.7 | 8.5 |

Minors (**) and Balance with water up to 100%

(*) Alkyl chain between C10 and C14, preferably between C12-13 and x = between 0 and 4, preferably between 0.5 and 2

(**) Minors: dyes, opacifiers, perfumes, preservatives, hydrotropes, processing aids, salts, stabilizers . . .

[1]Glutamic acid

[2]Diethylenetriamine penta methylphosphonic acid

[3]Diethylenetriamine pentaacetic acid

[4]Methyl glycinediacetic acid

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hand dishwashing detergent composition comprising:

(a) from about 0.2% to about 3% by weight of the total composition of a chelant comprising glutamic-N,N-diacetic acid or a derivative thereof, (b) from about 12% to about 45% by weight of the total composition of a surfactant system consisting of:

(i) an anionic surfactant present in an amount from about 3 to about 20% by weight of the total composition, (ii) an ethoxylated nonionic surfactant present at a level from about 3% to about 7% by weight of the total composition, and (iii) a coco dimethyl amine oxide amphoteric surfactant present at a level from about 0.5% to about 10% by weight of the total composition, wherein an average alkyl chain branching of the surfactants is at least about 20% by weight of the total surfactants and is provided by branched anionic surfactants, and wherein the weight ratio of total surfactant to nonionic surfactant is from about 2 to about 6, and wherein the composition does not include any additional surfactant other than the surfactant system.

2. The composition according to claim 1 wherein the nonionic surfactant is C10 alcohol ethoxylates with 5 EO.

3. A method of cleaning a dishware with a composition according to claim 1; said process comprising the steps of applying said composition onto said dishware.

* * * * *